US008860310B2

(12) United States Patent
Huang et al.

(10) Patent No.: US 8,860,310 B2
(45) **Date of Patent: *Oct. 14, 2014**

(54) LAMP WITH APPEARANCE DIFFERENTIATED FROM ITS MAIN ILLUMINATION

(71) Applicant: Osram Sylvania Inc., Danvers, MA (US)

(72) Inventors: Michelle Kun Huang, Manchester, NH (US); Glenn Freeman, Danvers, MA (US); Junwon Lee, Andover, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 170 days.

This patent is subject to a terminal disclaimer.

(21) Appl. No.: 13/681,236

(22) Filed: Nov. 19, 2012

(65) Prior Publication Data

US 2013/0335961 A1 Dec. 19, 2013

Related U.S. Application Data

(63) Continuation of application No. 12/864,044, filed as application No. PCT/US2009/066465 on Dec. 2, 2009, now Pat. No. 8,314,555.

(60) Provisional application No. 61/119,050, filed on Dec. 2, 2008.

(51) Int. Cl.

| | |
|---|---|
| ***F21V 29/00*** | (2006.01) |
| ***F21L 4/02*** | (2006.01) |
| ***F21K 99/00*** | (2010.01) |
| ***F21V 13/12*** | (2006.01) |
| *F21Y 101/02* | (2006.01) |
| *F21Y 105/00* | (2006.01) |

(52) U.S. Cl.

CPC ..... *F21V 13/12* (2013.01); *F21V 29/00* (2013.01); *F21Y 2101/02* (2013.01); *F21V 29/004* (2013.01); *F21K 9/1355* (2013.01); *F21Y 2105/005* (2013.01); *F21K 9/13* (2013.01); *Y10S 362/80* (2013.01)

USPC ..... 315/35; 315/32; 313/46; 362/84; 362/249; 362/310; 362/800

(58) Field of Classification Search

USPC ..... 315/32, 35, 312; 313/46, 113; 362/84, 362/184, 249, 252, 294, 235, 307, 310, 331, 362/363, 373

See application file for complete search history.

(56) References Cited

U.S. PATENT DOCUMENTS

| | | | | |
|---|---|---|---|---|
| 7,367,692 | B2 * | 5/2008 | Maxik | 362/307 |
| 2013/0286666 | A1 * | 10/2013 | Bakk | 362/363 |

* cited by examiner

*Primary Examiner* — Vibol Tan

(74) *Attorney, Agent, or Firm* — Shaun P. Montana

(57) ABSTRACT

A lamp including a two-sided source plate, a plurality of light sources, a lens, a diffuser plate, and a driver insulator is disclosed. One set of the light sources generates white light and is attached to one side of the source plate. Another set of the light sources generates colored light and is attached to the source plate's other side. The lens encapsulates the white light-generating set, and redirects that white light. The driver insulator and the diffuser plate are each in contact with the source plate's other side. The driver insulator, diffuser plate, and that side of the source plate define a light box region that contains the colored light-generating set of light sources. The driver insulator acts as a reflector, and the diffuser plate acts as a diffuser, such that colored light is dispersed from the light box region through the diffuser plate.

14 Claims, 2 Drawing Sheets

LAMP WITH APPEARANCE DIFFERENTIATED FROM ITS MAIN ILLUMINATION

CROSS-REFERENCE TO RELATED APPLICATIONS

The present application claims priority of U.S. Provisional Application No. 61/119,050, filed Dec. 2, 2008, PCT Application No. PCT/US09/66465, filed Dec. 2, 2009, and U.S. patent application Ser. No. 12/864,044, filed Jul. 22, 2010, the entire contents of all of which are hereby incorporated by reference.

TECHNICAL FIELD

The present invention relates to lamps, and more specifically, to lamps incorporating multiple light sources.

BACKGROUND

A typical LED lamp offers greater energy efficiency and longer life than a standard incandescent lamp. A typical LED lamp is more environmentally friendly than a standard compact fluorescent lamp, due to the lack of mercury in a typical LED lamp. With improvements in LED technology, the amount of lumens generated by LEDs, in particular by LEDs that generate white light, has improved rapidly over time, leading to more LED lamps in the marketplace. With these advantages over past lighting technologies, plus their ability to generate light in multiple colors, in addition to generating white light, LED lamps are widely seen as the future of lighting technology.

SUMMARY

Embodiments of the present invention provide a lamp that generates white light as its main illumination but also generates at least one colored light, separate from the white light, to differentiate the appearance of the lamp.

In an embodiment, there is provided a lamp. The lamp includes a source plate having a first side and a second side, and a plurality of light sources. A first set of the plurality of light sources generates white light and is attached to the first side of the source plate. A second set of the plurality of light sources generates colored light and is attached to the second side of the source plate. The lamp also includes a lens that encapsulates the first set of the plurality of light sources and redirects the white light generated by the first set of the plurality of light sources. The lamp also includes a diffuser plate and a driver insulator. The diffuser plate and the driver insulator are each in contact with the second side of the source plate. The diffuser plate, the driver insulator, and the second side of the source plate define a light box region in which the second set of the plurality of light sources is located. The driver insulator acts as a reflector (that is, a surface of the driver insulator is diffusively reflective), and the diffuser plate acts as a diffuser, such that colored light generated by the second set of the plurality of light sources is dispersed from the light box region through the diffuser plate.

In a related embodiment, the plurality of light sources may be a plurality of LEDs. In a further related embodiment, the first set of the plurality of light sources may be a set of LEDs that generate white light, and the second set of the plurality of light sources may be a set of LEDs that generate colored light.

In another related embodiment, the lamp may include a switch mechanism. The switch mechanism allows power to be provided to only the first set of the plurality of light sources, to only the second set of the plurality of light sources, and to the plurality of light sources. In yet another related embodiment, the lens may include collimating optics and a diffuser. In a further related embodiment, the diffuser palte and the diffuser of the lens may be made of the same material.

In still another related embodiment, the lamp may include driver electronics, wherein the driver electronics drive the first set of the plurality of lights sources and the second set of the plurality of light sources. In a further related embodiment, the driver insulator may surround the driver electronics.

In yet still another related embodiment, the first set of the plurality of light sources may be oriented in a first direction, and the second set of the plurality of light sources may be oriented in a second direction. In a further related embodiment, the second direction may be 180 degrees different from the first direction. In another further related embodiment, the second set of the plurality of light sources may be oriented at an acute angle offset from the second direction.

In still yet another related embodiment, an exterior surface of the diffuser plate may be dome-shaped, and may serve as an outer wall of the lamp. In yet still another related embodiment, the source plate may be a printed circuit board. In a further related embodiment, the lamp may include a heat sink surrounding the plurality of light sources and the printed circuit board, wherein the heat sink and the printed circuit board prevent colored light generated by the second set of the plurality of light sources from mixing with white light generated by the first set of the plurality of light sources.

In yet another related embodiment, the second set of the plurality of light sources may include a first group that generates light of a first color and a second group that generates light of a second color, and the lamp may further include a divider, the divider placed within the light box region, between the driver insulator and the diffuser plate, such that the light box region is divided into a first region and a second region, wherein the first region disperses light of the first color generated by the first group, and wherein the second region disperses light of the second color generated by the second group.

In another embodiment there is provided a retrofit lamp. The retrofit lamp includes a base, the base connectable into a lamp socket; a source plate having a first side and a second side; a plurality of LED-based light sources, wherein a first set of the plurality of LED-based light sources generates white light and is attached to the first side of the source plate, and wherein a second set of the plurality of LED-based light sources generates colored light and is attached to the second side of the source plate; driver electronics to drive the plurality of LED-based light sources, wherein the driver electronics are electrically connected to the base and the source plate; a driver insulator that surrounds the driver electronics, extends from the base to the source plate and is in contact with the second side of the source plate; a lens that encapsulates the first set of the plurality of LED-based light sources and disperses the white light generated by the first set of the plurality of LED-based light sources; a diffuser plate, the diffuser plate in contact with the second side of the source plate, wherein the diffuser plate, the driver insulator, and the second side of the source plate define a light box region in which the second set of the plurality of light sources is located, and wherein the driver insulator acts as a reflector and the diffuser plate acts as a diffuser, such that colored light generated by the second set of the plurality of light sources is dispersed from the light box region through the diffuser plate; a retaining ring that connects the diffuser plate to the base; and a heat sink that connects the lens to the diffuser plate.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
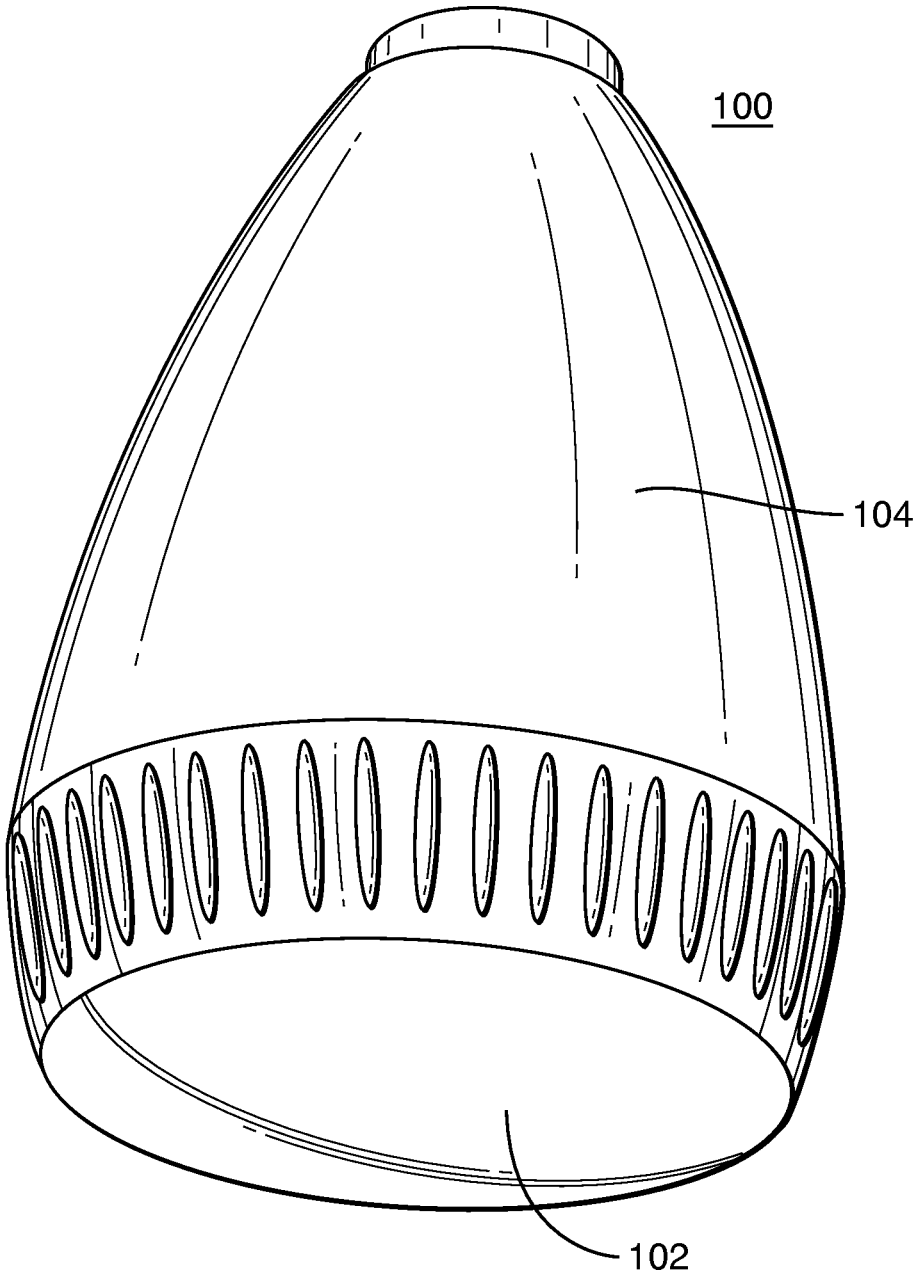
FIG. 1 shows a lamp with its appearance differentiated from its main illumination according to embodiments disclosed herein.

FIG. 1 shows a lamp 100 according to embodiments described herein. When power is provided to the lamp 100, a first light is dispersed from a bottom 102 of the lamp 100. This first light, in some embodiments, is white light, or substantially white light, though of course in other embodiments it may non-white (i.e., colored) light. Simultaneously, a second light is dispersed from a side 104 of the lamp 100. This second light, in some embodiments, is light of a particular color (e.g., yellow, green, red, blue, orange, purple, etc.), though of course in other embodiments it may be white light or substantially white light. The second light, when different from the first light, differentiates the lamp 100 from its main illumination (i.e., the first light dispersed from the bottom 102 of the lamp 100). This provides an aesthetic element to the lamp 100, one that may be adjusted to produce any number of desired colors for the second light.

Figure 2:
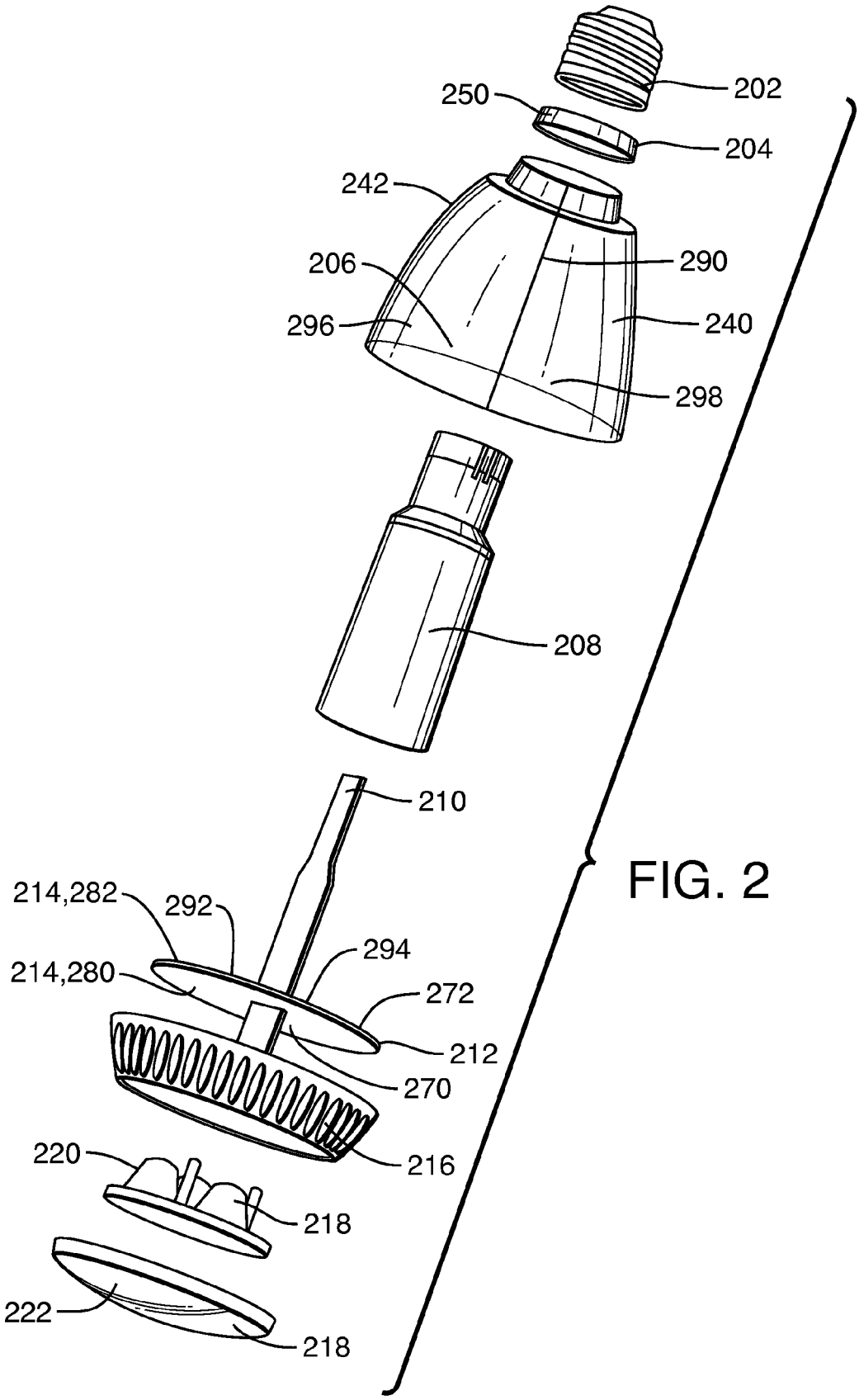
FIG. 2 illustrates the components of a lamp with its appearance differentiated from its main illumination according to embodiments disclosed herein, and how those components fit together to form the lamp.

An embodiment of the lamp 100 is shown in greater detail in FIG. 2, which illustrates various components of the lamp 100. The lamp 100 includes a base 202 that allows the lamp 100 to be inserted into a socket. The base 202 may be any type of known lamp base, including but not limited to the screw-type base shown in FIG. 2. The lamp 100 also includes a source plate 212 having a first side 270 and a second side 272. The source plate 212 may be of any shape so as to fit within the lamp 100. Thus, in some embodiments, the source plate 212 may have a straight or substantially straight planar shape (i.e., such that the first side 270 and the second side 272 are flat or substantially flat), while in other embodiments, the source plate 212 may have a non-planar or substantially non-planar shape (i.e., such that the first side 270 and the second side 272 are curvy or substantially curvy). In some embodiments, the source plate 212 may be a printed circuit board. Attached to the source plate 212 is a plurality of light sources 214. The plurality of light sources 214 may be any type of light sources, and in some embodiments, are LED-based light sources, such as but not limited to LEDs, OLEDs, and the like. The plurality of light sources may be divided into sets. In some embodiments, the plurality of light sources 214 is divided into a first set 280 and a second set 282. The first set 280 and the second set 282 each generate at least one light (i.e., white, substantially white, non-white, colored, etc.) that is different from at least one light generated by the other set. Thus, in some embodiments, the first set 280 of the plurality of light sources 214 generates white light, or substantially white light. The second set 282 of the plurality of light sources 214 generates colored light (i.e., light of a specific color). Thus, in embodiments where the plurality of light sources 214 is a plurality of LEDs, the first set 280 is a set of LEDs that generate white light, and the second set 282 is a set of LEDs that generated colored light. In some embodiments, the second set 282 is capable of generating different colored light at different times (e.g., first red, then orange, then yellow, then red, repeating the cycle). Alternatively, or additionally, the second set 282 is capable of simultaneously generating different colored light (e.g., red, yellow, and green light all at the same time). Further, in some embodiments, either or each of the first set 280 and the second set 282 is/are capable of generating white (and/or substantially white) light, and colored light (one or many colors). Whatever light is generated thereby, the first set 280 of the plurality of light sources 214 is attached to the first side 270 of the source plate 212, and the second set 282 of the plurality of light sources 214 is attached to the second side 272 of the source plate 212.

The lamp 100 also includes a diffuser plate 206. The diffuser plate 206, in some embodiments, includes a volume diffuser, such as but not limited to a plate containing scattering particles, a surface diffuser, and/or a frosted glass plate. The diffuser plate 206 may be of any shape, including both planar and non-planar shapes. Whatever the shape of the diffuser plate 206, the diffuser plate 206 has an interior region. When the components of the lamp 100 shown in FIG. 2 are joined together, the diffuser plate 206 is in contact with the second side 272 of the source plate 212. The second side 272 of the source plate 212 then closes off the region created by the diffuser plate 206. That is, the diffuser plate 206, the second side 272 of the source plate 212, and a driver insulator 208 define a region from the interior region of the diffuser plate 206; this defined region is known as a light box region 240. The second set 282 of the plurality of light sources 214 is located within the light box region 240. Thus, the diffuser plate 206 acts only upon the second set 282 of the plurality of light sources 214, and not upon the first set 280 of the plurality of light sources 214. In some embodiments, the width of the light box region 240, may be only as large as the width of one of the second set 282 of the plurality of light sources 214 contained therein. When the second set 282 comprises LEDs, the width is thus only as large as the width of one of the LEDs. The driver insulator 208 acts as a reflector in regards to light generated by the second set 282 of the plurality of light sources 214. Simultaneously, the diffuser plate 206 acts as a diffuser in regards to light generated by the second set 282 of the plurality of light sources 214. This causes light (in some embodiments, colored light of a particular color) generated by the second set 282 of the plurality of light sources 214 to be dispersed from the light box region 240 through the diffuser plate 206. That is, light generated by the second set 282 of the plurality of light sources 214 is directed away from the source plate 212, reflects off the driver insulator 208, and is diffused (i.e., dispersed) by and through the diffuser plate 206. The source plate 212 keeps the light generated by the second set 282 of the plurality of light sources 214 from mixing with the light generated by the first set 280 of the plurality of light sources 214.

As stated above, the diffuser plate 206 may be formed in any shape, and in some embodiments, has a dome or dome-like shape, as seen in FIG. 2. Alternatively, or additionally, in some embodiments, the shape of an exterior surface 242 of the diffuser plate 206 may be formed in a first shape (e.g., the dome shape shown in FIG. 2) that is the same, or substantially similar to, the shape of the driver insulator 208. Alternatively, or additionally, in some embodiments, the shape of the exterior surface 242 of the diffuser plate 206 may be the same as the shape of the driver insulator 208. The diffuser plate 206 may be made from any material that is capable of diffusing light, such as but not limited to glass (clear or frosted), clear (i.e., transparent or mostly transparent) or frosted plastic, and the like. In some embodiments, the diffuser plate 206 is made of a single material that acts as a diffuser, while in other embodiments, the diffuser plate 206 is made from a number of materials that act in concert as a diffuser. A portion of the diffuser plate 206 that will be attached to the base 202 is shaped in a way to make this attachment possible. For example, the diffuser plate 206 may be shaped to include grooves that would match grooves found on the base 202, allowing the base 202 to be screwed onto the diffuser plate 206. Alternatively, or in some embodiments additionally, the diffuser plate 206 may be shaped to attach to a retaining ring 204 that serves as a mechanical connector between the diffuser plate 206 and the base 202. Of course, the diffuser plate 206 and the base 202 may be attached in any known way, including but not limited to mechanical attachments and/or through use of any adhesive material or materials, and/or through combinations of these.

In some embodiments, the lamp 100 may be configured such that the second set 282 generates, and the diffuser plate 206 diffuses, two or more colored lights simultaneously (including showing white light, or substantially white light, and a colored light). In such embodiments, the second set 282 of the plurality of light sources 214 is itself divided into groups. In embodiments where there are two colored lights shown simultaneously, the second set 282 of the plurality of light sources 214 is comprised of a first group 292 that generates light of a first color and a second group 294 that generates light of a second color. The lamp then includes a divider 290 that is placed inside of the light box region 240. More specifically, the divider 290 is placed between the driver insulator 208 and the diffuser plate 206. The divider 290 divides the light box region 240 into a first region 296 and a second region 298. The first region 296 disperses light of the first color generated by the first group 292, and the second region 298 disperses light of the second color generated by the second group 294. Thus, the divider 290 may be made from any material that completely blocks the transmission of light, or alternatively, may be made from any material that is able to be used within a lamp, such as the lamp 100, without deforming (e.g., is able to withstand the heat generated within the lamp) and is coated with a substance that completely blocks the transmission of light. Of course, it is possible to have multiple dividers within a lamp 100, with corresponding groups (i.e., subsets) of the second set 282 of the plurality of light sources 214. Thus, in some embodiments, there may be three, four, five, etc. different colors of light simultaneously shown through the diffuser plate 206. Alternatively, or additionally, in some embodiments there may be a repeating pattern of different colors of light simultaneously around the diffuser plate 206. Any combination of colored lights, generated by any combination of light sources that generate colored light, is possible.

The plurality of light sources 214, in some embodiments, is oriented in a particular direction or directions; that is, the plurality of light sources 214 is aimed at an angle in relation to the source plate 212 and/or in relation to other light sources in the plurality of light sources 214. The direction of orientation for a light source in the plurality of light sources 214, in some embodiments, depends on which set of light sources the light source belongs to, either the first set 280 or the second set 282. That is, in some embodiments, the first set 280 of the plurality of light sources 214 is oriented in a first direction, and the second set 282 of the plurality of light sources 214 is oriented in a second direction. In some embodiments, the second direction is 180 degrees different from the first direction, such that the second set 282 of the plurality of light sources 214 is oriented in the opposite direction as the first set 280 of the plurality of light sources 214. For example, where the source plate 212 has a planar shape and its first and second sides 270, 272 are flat, the first set 280 may be oriented perpendicularly with respect to the first side 270 of the source plate 212, and the second set 282 is then orientated perpendicularly with respect to the second side 272 of the source plate 212. In some embodiments, the second set 282 of the plurality of light sources 214 may then be further oriented at an acute angle offset from the second direction. Thus, for example, in such embodiments, the second set 282 of the plurality of light sources 214 may be angled so as to be facing the driver insulator 208. In some embodiments, such orientation of the second set 282 of the plurality of light sources 214 gives a better diffusion of the colored light produced by the second set 282 of the plurality of light sources 214.

Light (including white, or substantially white, light, and in some embodiments, alternatively or additionally one or more colored lights) produced by the first set 280 of the plurality of light sources 214 within the lamp 100 is acted upon by a lens 218. The lens 218 encapsulates the first set 280 of the plurality of light sources 214 and redirects the light generated by the first set 280 of the plurality of light sources 214. The lens 218 is thus made from any material that is capable of redirecting light, such as but not limited to glass, plastics, and the like. In some embodiments, the lens 218 is a single piece, while in other embodiments, as shown in FIG. 2, the lens 218 is made from collimating optics 220 and a diffuser 222. The collimating optics 220 may be made of one or more optics that focus the light generated by the first set 280 of the plurality of light sources 214, and the diffuser 222 then diffuses that focused light in a desired pattern. In some embodiments, the diffuser plate 206 and the diffuser 222 of the lens 218 are made of the same material.

Driver electronics 210 within the lamp 100 receive power through the base 202 and use that power to drive the plurality of light sources 214, including both the first set 280 and the second set 282. Thus, the driver electronics 210 are connected (i.e., electrically connected) to the source plate 212, and transfer power to the plurality of light sources 214 attached to the source plate 212. The driver electronics 210 may be any type of driver or drivers that are able to drive the plurality of light sources 214. In some embodiments, the driver electronics 210 include a first driver to drive the first set 280 of the plurality of light sources 214, and a second driver to drive the second set 282 of the plurality of light sources 214. Additionally, or alternatively, in some embodiments, the driver electronics 210 may drive the first set 280 of the plurality of light sources 214 at a different voltage and current than the second set 282 of the plurality of light sources 214. The driver electronics 210 is surrounded by the driver insulator 208, which (in addition to serving as a reflector for the second set 282 of the plurality of light sources 214) protects the driver electronics 210 from the light and heat generated by the second set 282 of the plurality of light sources 214. The driver insulator 208 thus extends from the base 202 to the source plate 212, and in some embodiments, may extend through the source plate 212 should the driver electronics 210 also extend through the source plate 212. The driver insulator 208 may be made of any insulating material, such as but not limited to a plastic material. In some embodiments, the exterior of the driver insulator 208 may be made of reflective material, or additionally or alternatively, may be coated with a reflective material, or a combination of these.

The lamp 100 has a heat sink 216 that acts as a thermal conductor to assist in dissipating heat generated by the plurality of light sources 214. The heat sink 216 surrounds the plurality of light sources 214 and the source plate 212, transferring heat from the interior of the lamp 100 to the exterior of the lamp 100. In some embodiments, the heat sink 216 connects, or assists in connecting, the lens 218 to the diffuser plate 206. The heat sink 216 may be so connected through use of any mechanical or adhesive connection, or combinations thereof. The heat sink 216 may be made of any thermally conductive material, such as but not limited to metal, ceramic, thermally conductive plastics, and the like. The heat sink 216 may be of any shape and size and, in some embodiments, includes fins, bumps, and/or other extensions of its exterior surface area to assist in dissipating greater amounts of thermal energy. Further, in some embodiments, a pattern on the heat sink 216 may match a pattern on the retaining ring 204. In some embodiments, the heat sink 216 and the source plate 212 prevent light generated by the second set 282 of the plurality of light sources 214 from mixing with light generated by the first set 280 of the plurality of light sources 214.

In some embodiments, the lamp 100 may include a switch mechanism (shown in FIG. 2 as element 250 and attached to the retaining ring 204). The switch mechanism 250 allows power to be provided, from the base 202 via the driver electronics 210, to the plurality of light sources 214, and/or to subsets of the plurality of light sources 214. For example, the switch mechanism 250 may be configured to cycle through the following three stages: power to entire plurality of light sources 214, power to only the first set 280 of the plurality of light sources 214, power to only the second set 282 of the plurality of light sources 214. The switch mechanism 250 thus interfaces with the driver electronics 210 and controls which of the plurality of light sources 214 receives power, thus enabling different modes of operation for the lamp 100. The switch mechanism 250 may be configured to allow power to be provided to any set and/or subset of the plurality of light sources 214, such that numerous combinations are possible (i.e., provide power only to a portion (e.g., half) of the first set 280 of the plurality of light sources 214 and to the entire second set 282 of the plurality of light sources 214, etc.).

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lamp comprising:

a source plate having a first side and a second side, wherein the second side comprises a plate portion and an insulator portion;

a plurality of light sources, wherein a first set of the plurality of light sources generates white light and is attached to the first side of the source plate, and wherein a second set of the plurality of light sources generates colored light and is attached to the second side of the source plate;

a lens that encapsulates the first set of the plurality of light sources and redirects the white light generated by the first set of the plurality of light sources; and a diffuser plate and a driver insulator, each in contact with the second side of the source plate;

wherein the insulator portion of the second side extends so as to cover a portion of the driver insulator, such that the diffuser plate, the driver insulator, and plate portion and the insulator portion of the second side of the source plate define a light box region in which the second set of the plurality of light sources is located, and wherein the driver insulator acts as a reflector and the diffuser plate acts as a diffuser, such that colored light generated by the second set of the plurality of light sources is dispersed from the light box region through the diffuser plate.

2. The lamp of claim 1, wherein a first group of the second set of the plurality of light sources is placed on the plate portion of the second side, and wherein a second group of the second set of the plurality of light sources is placed on the insulator portion of the second side.

3. The lamp of claim 2, wherein the first group generates light of a first color and the second group generates light of a second color, the lamp further comprising:

a divider, the divider placed within the light box region between the plate portion and the insulator portion, such that the light box region is divided into a first region and a second region, wherein the first region disperses light of the first color generated by the first group, and wherein the second region disperses light of the second color generated by the second group.

4. The lamp of claim 3, wherein the divider extends across a portion of the light box region such that light emitted by the first group of the second set of the plurality of light sources colormixes with light emitted by the second group of the second set of the plurality of light sources.

5. The lamp of claim 2, wherein a subset of the second group of the second set of the plurality of light sources is angled relative to the insulator portion of the second side of the source plate.

6. The lamp of claim 2, wherein the first set of the plurality of light sources comprises a set of solid state light sources that generate white light, and wherein the second set of the plurality of light sources comprises a set of solid state light sources that generate colored light.

7. The lamp of claim 1, comprising:

a switch mechanism, wherein the switch mechanism allows power to be provided to only the first set of the plurality of light sources, to only the second set of the plurality of light sources, and to the plurality of light sources.

8. The lamp of claim 7, wherein the switch mechanism allows power to be provided to only the first group of the second set of the plurality of light sources, and to only the second group of the second set of the plurality of light sources.

9. The lamp of claim 1, comprising:

driver electronics, wherein the driver electronics drive the first set of the plurality of lights sources and the second set of the plurality of light sources, wherein the driver insulator surrounds the driver electronics.

10. The lamp of claim 1, wherein a portion of the insulator portion of the second side of the source plate acts as a reflector.

11. The lamp of claim 3, wherein the insulator portion of the second side of the source plate acts as a reflector.

12. The lamp of claim 11, wherein a portion of the divider facing the insulator portion of the second side of the source plate acts as a reflector.

13. The lamp of claim 3, wherein the plate portion of the second side of the source plate and a portion of the divider facing the plate portion each act as a reflector.

14. A retrofit lamp comprising:

a base, the base connectable into a lamp socket;

a source plate having a first side and a second side, wherein the second side comprises a plate portion and an insulator portion;

a plurality of solid state light sources, wherein a first set of the plurality of solid state light sources generates white light and is attached to the first side of the source plate, and wherein a second set of the plurality of solid state light sources generates colored light and is attached to the second side of the source plate;

driver electronics to drive the plurality of solid state light sources, wherein the driver electronics are electrically connected to the base and the source plate;

a driver insulator that surrounds the driver electronics, extends from the base to the source plate, is in contact with the second side of the source plate, and is at least partially covered by the insulator portion of the second side of the source plate;

a lens that encapsulates the first set of the plurality of solid state light sources and redirects the white light generated by the first set of the plurality of solid state light sources;

a diffuser plate, the diffuser plate in contact with the second side of the source plate, wherein the diffuser plate, the driver insulator, and the plate portion and the insulator portion of the second side of the source plate define a light box region in which the second set of the plurality of light sources is located, and wherein the driver insulator acts as a reflector and the diffuser plate acts as a diffuser, such that colored light generated by the second set of the plurality of light sources is dispersed from the light box region through the diffuser plate;

a retaining ring that connects the diffuser plate to the base; and a heat sink that connects the lens to the diffuser plate.

* * * * *